United States Patent [19]

Oyama

[11] 4,062,446

[45] Dec. 13, 1977

[54] CIGARETTE FILTER PIPE KIT

[76] Inventor: George Clement Oyama, 9, Shiba, Nishi-Kubo, Shiroyama-cho, Minato, Tokyo, Japan

[21] Appl. No.: 766,250

[22] Filed: Feb. 7, 1977

[51] Int. Cl.[2] ..... B65D 69/00; B65D 71/00

[52] U.S. Cl. ..... 206/223; 206/443; 131/10.1

[58] Field of Search ..... 206/223, 226, 427, 443, 206/526, 820; 131/10.1

[56] References Cited

U.S. PATENT DOCUMENTS

| | | | |
|---|---|---|---|
| 3,122,145 | 2/1964 | St. Louis | 131/10.1 X |
| 3,848,739 | 11/1974 | Fagan | 206/443 |

*Primary Examiner*—George T. Hall
*Attorney, Agent, or Firm*—James R. Cypher

[57] ABSTRACT

A cigarette filter pipe kit in which the filter pipes are manufactured, shipped and sold to the customer in dry form. The customer utilizes the packaging container to moisten the filters and to assemble the filter pipes for use. A plurality of pipes are packaged in a container with only the metal heat shield in place and the dry cellulose filter inserted therein. The caps and plugs for the filter pipes are packaged separately or in a tray within the package together with a small pouch for carrying one or more assembled filter pipes. The customer moistens the cellulose filter, caps and plugs the filter pipes and returns the completed filter pipes to the original packaging container or to the small pouch.

10 Claims, 15 Drawing Figures

3
12
42
2
46
5
5
8
8
7
7
3
6
13

42
39
43
37
2
11
14
44
6
6
16
8
18
17
4
36
22
38
23
24
26
27
28
6
13

12
72
2
14
8
18
34
17
19
21
22
6

CIGARETTE FILTER PIPE KIT

BACKGROUND OF THE INVENTION

Great numbers of filter pipes for holding cigarettes and filtering the smoke are sold in the United States and foreign countries. In one system the filter pipe consists of a small plastic pipe having an open end for holding a cigarette and a cylindrical mid-portion for containing a length of cotton moistened with water. A common brand of such a filter is sold under the trademark Aqua Filter. The prior art filters are completely assembled at factories and shipped to retail stores where they may be shelved for several weeks. The ends of the filter pipes are sealed but moisture can and sometimes does escape from the filter pipes; especially if they are subjected to elevated temperatures, held on shelves an unduly long time or the seals were improperly seated at the factory.

The effectiveness of the filter pipes is greatly reduced with any significant loss of moisture and the combined costs of labor in assembling the filters and the purchase of seals capable of effectively sealing the pipes adds greatly to the cost of the product.

The prior art filters are packaged by attaching several filters to a card. The package is not usable as a dispenser and is thrown away at the time of use of the first filter. The loose filters are then carried in a pocket or purse until needed.

SUMMARY OF THE INVENTION

The purpose of the invention is to decrease the cost of filter pipes to the consumer by packaging and shipping the pipes in a dry state to the retail store. The ultimate user adds water to the pipes prior to use and caps and plugs the pipes to prevent loss of water.

A further objective is to insure an operable product by eliminating the problem of loss of moisture in the filter between the factory and the time of use.

Still another object is to provide a small carrying case for a days supply of filters.

A still further object is to provide a multiple use container which can be used to package the product for shipment, and shelving; that can be used as a vessel for saturating the filter with water, and that can be used as an attractive dispenser for the assembled pipes.

DESCRIPTION OF THE INVENTION

Figures 1, 1A:
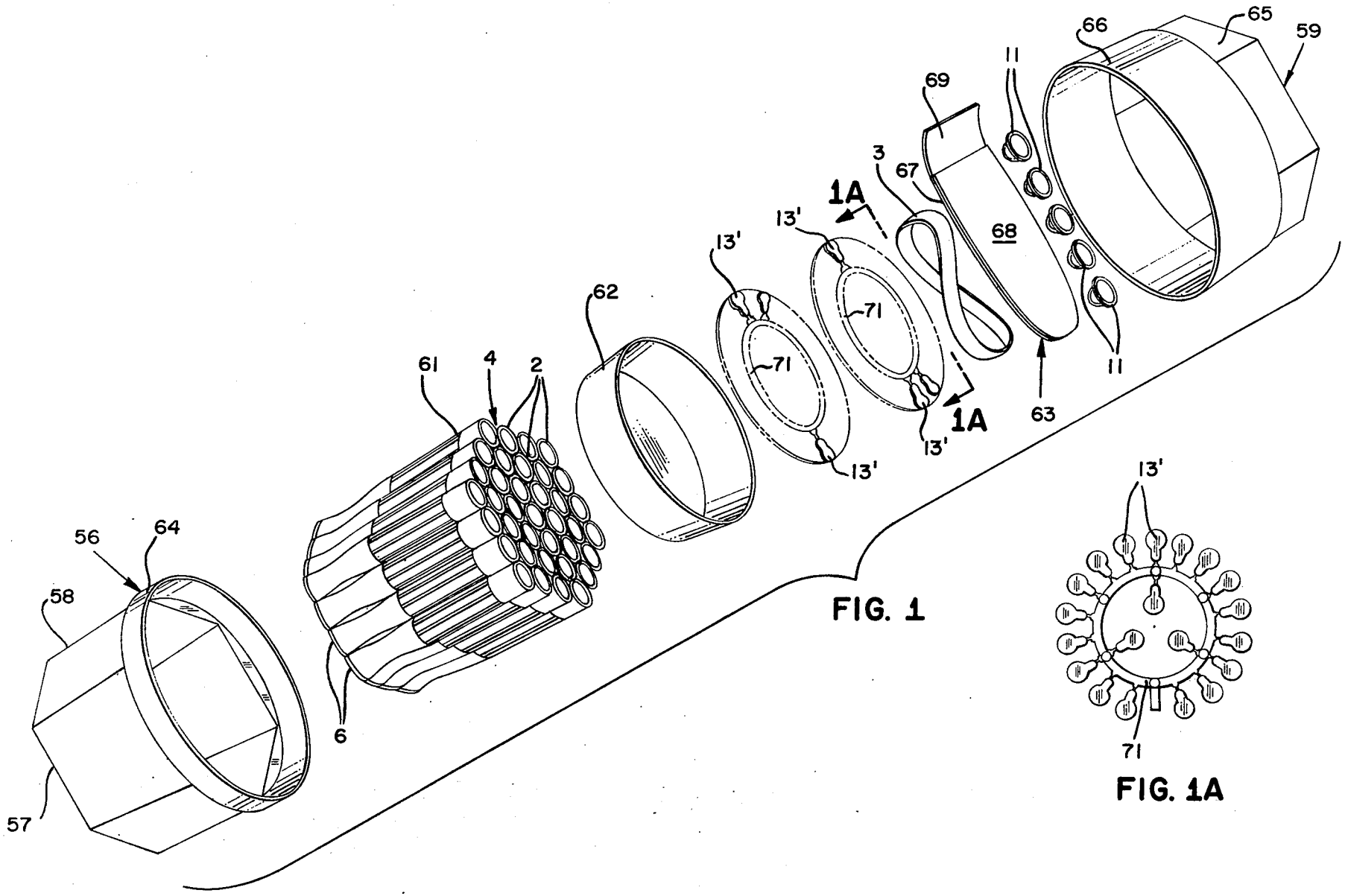
FIG. 1 is an exploded perspective view of the kit of the present invention.
FIG. 1A is a plan view of the pipe plugs.
Figures 2, 3, 4:
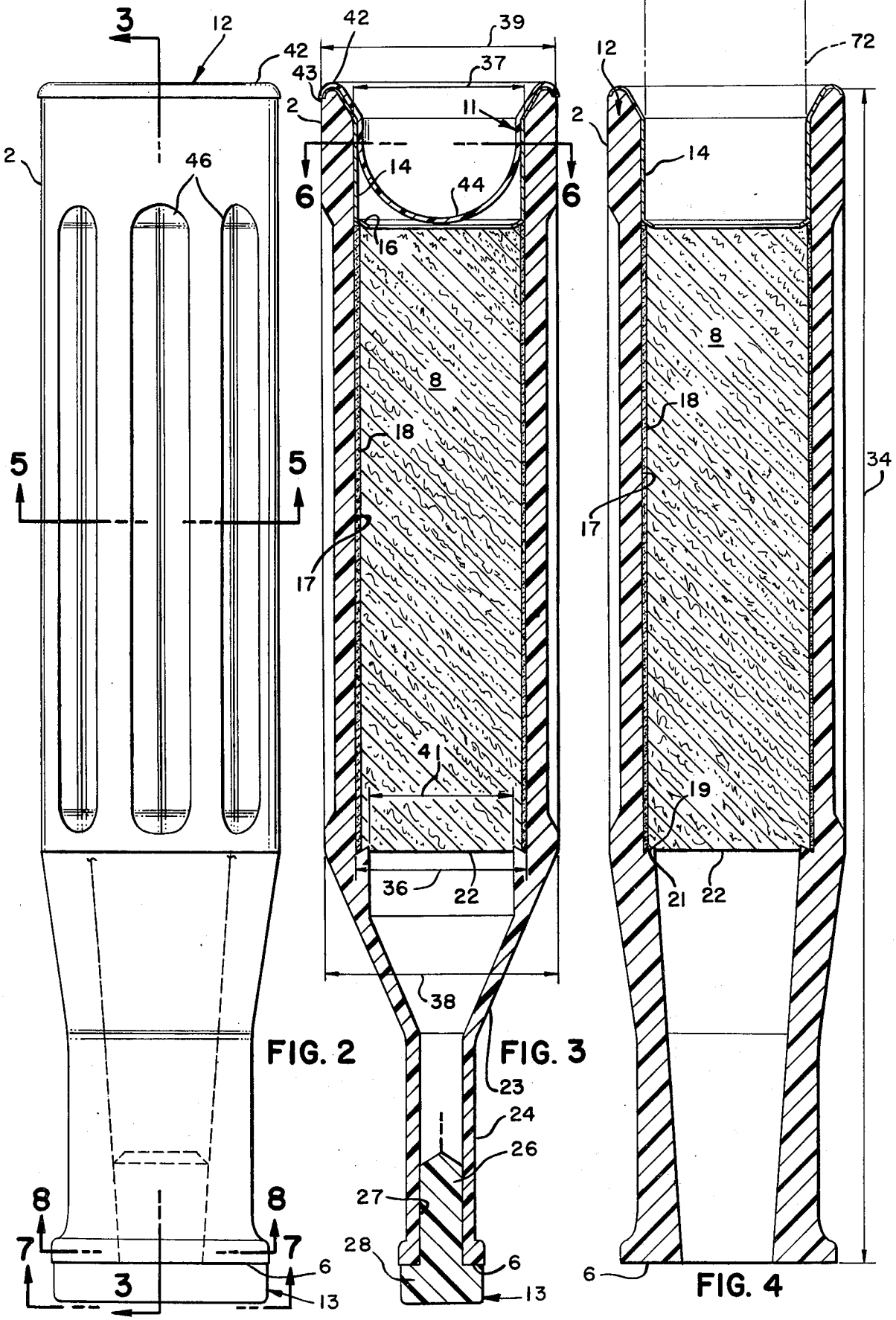
FIG. 2 is a greatly enlarged view of a single filter pipe.
FIG. 3 is a cross sectional view of the pipe of FIG. 2 taken along line 3—3. The filter pipe is shown in the completely assembled form.
FIG. 4 is a cross sectional view of the filter pipe of FIG. 2 with the plugs and caps removed and a cigarette 72 placed in the end of the filter pipe.

The cigarette filter pipe kit of the present invention consists briefly of a container 56 having a hexagonal shaped base 57 and a six sided upstanding sidewall 58 having a height less than the length of the filter pipes. The container includes a lid 59 dimensioned for registration with the container and covering the protruding ends 61 of the pipes. A plurality of cigarette filter pipes 2 are contained in the container. A plurality of first sealing means 13 for sealing the mouth piece end 6 of the pipes are placed in the container along with a plurality of second sealing means 11 for sealing the cigarette holding end 12 of the pipes.

Preferably the container is constructed from a water impermeable material such as plastic for use in holding water to moisten the fiber in the pipes.

In the kit illustrated in the drawings, a tray 62 is dimensioned to rest on top of the pipes and to hold the first and second sealing means.

Also included in the tray is an elastic means 3 such as a rubber or plastic band for banding the pipes together when the moisture is added.

To complete the kit, a small carrying container 63 is dimensioned for placement within the tray and is dimensioned for containing at least two pipes after the moisture has been added and the seals been set in place.

As illustrated in the drawings, the pipes have a slight taper. Preferably the walls of the container and lid also have a slight taper and diverge outwardly. As an added feature, the intersections of the upstanding walls of the container may be formed with a radius substantially the same as the radius of the pipes for snugly holding the pipes.

The unique hexagonal shape of the container was carefully chosen to hold the greatest number of pipes in the smallest type of container. This container holds 37 or 61 pipes. Because it may be cheaper to load the container at the factory in multiples of 12 pipes, the middle pipe may be omitted and the package may only contain 36 or 60 pipes.

It was found that it is difficult to place a hexagonal shaped lid on a hexagonal shaped container. For this reason, the container was formed as illustrated with a circular wall 64 at its upper end and the lid is formed with a hexagonal portion 65 and also formed with a circular mating wall 66.

The method of practicing the present invention briefly consists of banding a plurality of fiber filled filter pipes 2 together with a removable band 3 in a compact bundle 4 with the mouth piece ends 6 on substantially a single plane; partially submerging the filter pipes in water 7 until the fiber fill 8 in the pipes is dampened; placing a removable seal 11 in the cigarette holding end 12 of the filter pipes; and placing a removable seal 13 on the mouth piece end 6 of the filter pipes.

The filter pipe of the present invention is illustrated in detail in FIGS. 1, 2, 3 and 4. In general, the invention may be practiced with the basic parts set forth above. For purposes of describing one form of the invention, however, a detailed description of the filter pipe follows.

The filter pipe consists of a plastic tube having a cigarette holding end 12 with an inside wall diameter slightly smaller than the diameter of a standard cigarette. Preferably a metallic liner 14 is inserted into the end of the filter pipe. The liner serves the purpose of dissipating heat when the cigarette is burned down to a length which brings the hot ash in proximity to the plastic filter. The liner, when formed with an annular shoulder 16 also serves to hold the fiber filter in the filter pipe. Since the metallic liner can be manufactured to closer tolerances than the plastic, the liner also reduces the need to hold the inside diameter to very close tolerances. The close tolerances of the metallic liner are necessary to insure a tight seal of the removable end seal 11. The metal liner can be either inserted at the factory or by the user.

The pipe filter preferably is formed with a right cylindrical chamber 17 for receiving the right cylindrical fiber filter 8. Preferably this filter is constructed from a quantity of cotton enclosed is a paper sleeve 18. Other filters which can absorb water may also be used.

In order to securely hold the fiber filter within the chamber of the pipe filter, the pipe may be formed with an annular inwardly protecting collar 19 which is formed with a tapered wall to slightly compress by wedging the outward end edge 21 of the fiber at the end 22.

The mouth piece end of the filter pipe necks down at portion 23 to a generally eliptcal elongated portion 24.

A seal covering the mouth piece end is required to retain the moisture within the filter pipe. Preferably the removable seal 13 is provided with a shaft 26 which frictionally and sealably fills the inside passage 27 and a head portion 28 mates with the end wall 6 of the mouth piece. The end plug is preferably made of a plastic material. The seals 13 may be manufactured in multiples of 20 with one end attached to a ring 71 made of the same material as the plugs. Individual plugs can then be broken off the ring when the pipes are plugged by the user as shown in FIG. 1A.

The factory packaging of the pipes without water in a multipurpose container is a key factor in the commercial success of the present invention.

The pipes themselves are relatively rigid and if tightly assembled together they can be packaged in a thin wall shipping container. A unique packaging method was worked out in which 36, 37, 60 or 61 pipes in a hexagonal configuration are positioned in a hexagonal container. Pipes packaged in this way can be sold at greatly reduced cost to the consumer for several reasons; since there is no water in the pipes, they are lighter and cheaper to ship. Since there is no water in the pipe, less care and precision of assembly at the factory since no water seals need be placed on the ends of the pipe. Finally, since the pipes have no water, they can be shelved by the retailer indefinitely.

Upon purchase of the pipes as packaged as illustrated in FIG. 1, the user may either shelve the pipes in the factory package or he may prepare the pipes for use.

Figure 10:
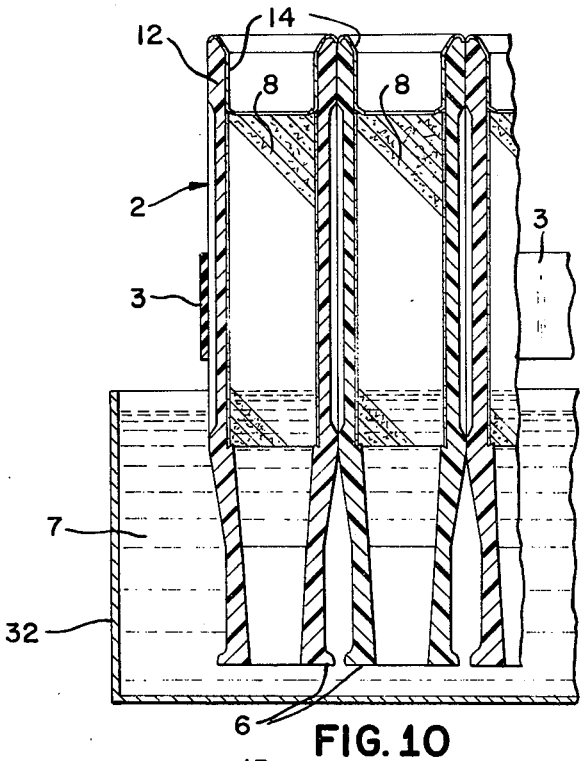
FIG. 10 is a partial cross sectional view of several pipes immersed in the container package filled with water.
Figure 11:
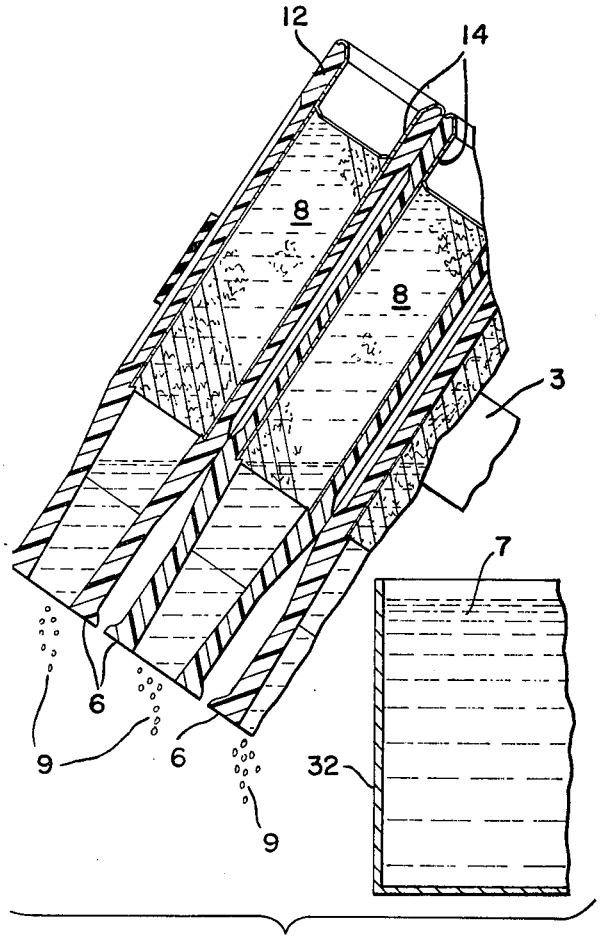
FIG. 11 is a partial view of the pipes and partly in cross section showing the pipes after removal from the water.
Figure 12:
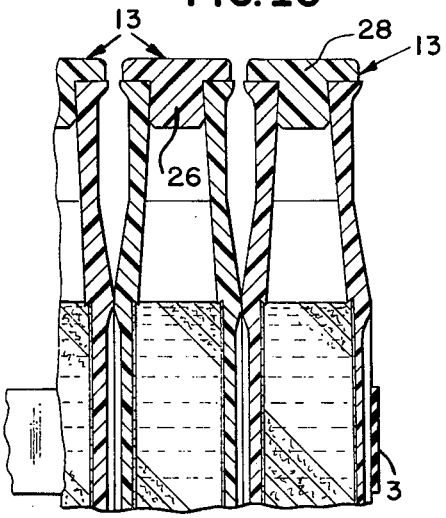
FIG. 12 is a partial view of several of the filter pipes in cross section with the end plugs in place.
Figure 13:
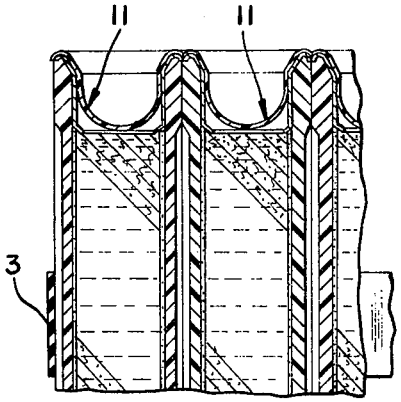
FIG. 13 is a partial view of several filter pipes and in cross section. The caps have just been placed on the cigarette end.

The steps for moistening the pipes and preparing them for use are quite easily accomplished. First, the outer wrapper, if any, is removed from the container. A rubber band 3 is placed around the pipes and they are then removed from the container as a unit. The lower portion of the container 56 or a small bowl 32 is then filled with enough water 7 to bring the level above the lower portion of the fiber filter when the pipes are returned to the container. With the band 3 around the plurality of pipes, the mouth piece ends of the pipes are submerged in water. As previously stated, the pipes must be submerged at least to the level where the water contacts the cotton filler. Preferably, the pipes are not submerged substantially below the point as shown in FIG. 10 so that the cotton is dampened primarily by permitting the water to rise through the cotton by the method of osmosis. It is preferable to use container 58 since it is dimensioned so that the container depth is less than the length of the pipe so that water cannot enter from end 12 of the pipe. When the entire filter is dampened, the bundle of pipes is lifted from the water and water in the hollow stem portion is permitted to drain as shown in FIG. 10. Since the fiber filters are dampaned by osmosis, little if any water will drain from the fiber filter material. When the water has been drained, the bundle is inverted and the mouth piece plugs which have been separately packaged and supplied with the pipes are inserted one by one into the mouth piece end of each filter pipe as shown in FIG. 12. Next, the bundle is inverted again the the cigarette holding end is placed in an upright position and the seal members are placed over the ends of the filter pipes, as illustrated in FIg. 13. With both ends of the filter pipe sealed, the rubber band 3 may be removed and the filter pipes are preferably retained in the original packaging container.

Two completed pipes may then be placed in the small container 63 which may be inexpensively manufactured from two pieces of plastic 67 and 68 and formed with a flat 69 which may be tucked into the container to cover the two pipes and securely hold them until they are needed.

A preferred form of the filter pipe used in the present invention is shown in FIGS. 1 - 4. The invention of course could be practiced with other types of pipes but the present design offers several important features.

The length 34 of the pipe is approximately 56.5 mm. In order to securely hold the cylindrical cotton fill member, the chamber 17 is tapered. The inside diameter 36 near the mouth piece end is 7.8 mm and the inside diameter 37 near the cigarette holder end is 8.2 mm. The use of a greater diameter opening at the holding end enables the user to more easily insert the cylindrical cotton fill member.

As previously explained, the outside wall of the filter pipe tapers. The outside diameter 38 at the mouth piece end is 11.2 mm, and the diameter 39 at the holder end is 10.6 mm.

In order to hold the filter in the chamber, the diameter 41 of the inwardly projecting collar 19 is 7 mm.

The cap for the holder end of the pipe is preferably made from plastic with an annular outer rim 42 which sealably engages the outer periphery 43 of the pipe. The central portion protrudes into the opening in a hemispherical portion 44 which extends nearly to the inner metal shoulder 16.

Figure 5:
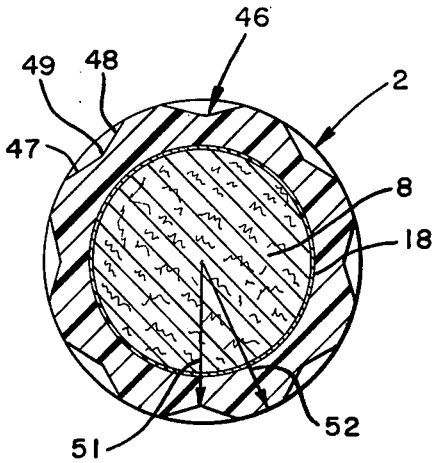
FIG. 5 is a cross sectional view of a filter pipe taken along line 5—5 of FIG. 2.
Figure 6:
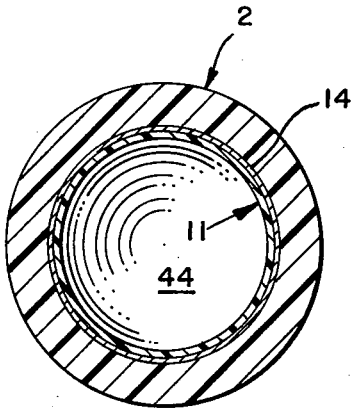
FIG. 6 is a cross sectional view of a filter pipe taken along line 6—6 of FIG. 3.
Figure 7:
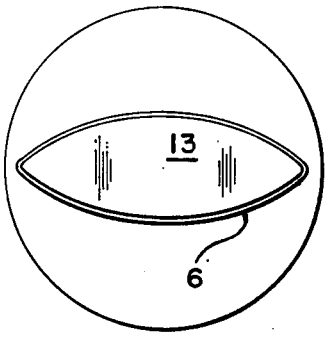
FIG. 7 is an end view of a filter pipe taken along line 7—7 of FIG. 2.
Figure 8:
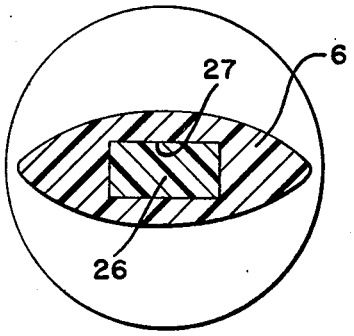
FIG. 8 is a cross sectional view of a filter pipe taken along line 8—8 of FIG. 2.

In order to lighten the pipe and to make it more attractive, a plurality of longitudinal fluted indents 46 are formed in the outer wall. As shown in FIG. 5 these flutes are formed with angularly related walls 47 and 48 meeting at line 49. The inner radius 51 of the flute is approximately 4.9 and the outer radius 52 is approximately 5.3 mm.

Figure 14:
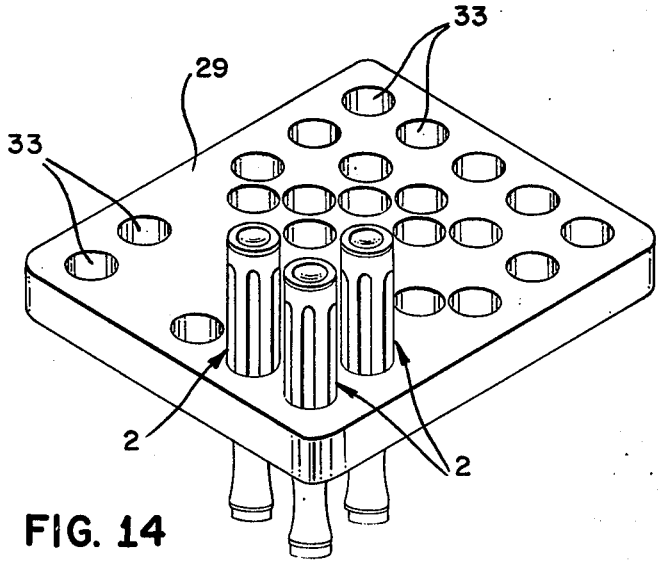
FIG. 14 is a perspective view of an alternate form of the invention.
Figure 9:
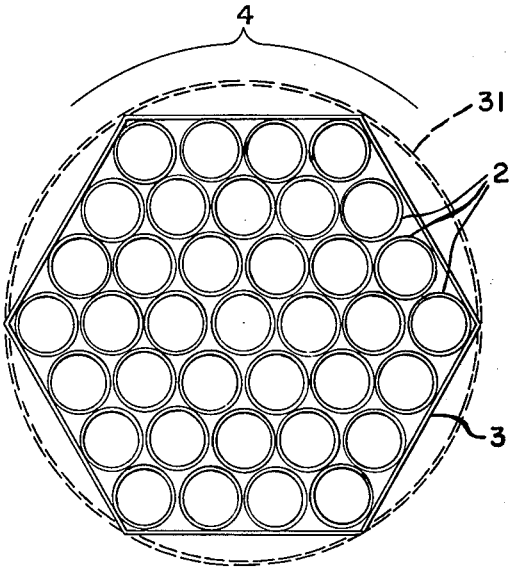
FIG. 9 is a top plan view of the pipes contained by a rubber band within the container.

An alternate form of combined shipping containers and tray 29 is illustrated in FIG. 14. The pipes are contained in openings 33. The tray may be made from plastic.

I claim:

1. A kit for moisture filled cigarette filter pipes comprising:

a. a container having a hexagonal shaped base and a six sided upstanding sidewall having a height less than the length of said pipes;

b. a lid dimensioned for registration with said container and covering the protruding ends of said pipes;

c. a plurality of cigarette filter pipes contained in said container;

d. a plurality of first sealing means for sealing the mouth piece end of said pipes placed in said container; and e. a plurality of second sealing means for sealing the cigarette holding end of said pipes placed in said container.

2. A kit described in claim 1 comprising:

a. said container is constructed from a water impermeable material for use in holding water to moisten said fiber in said pipes; and b. said kit includes a tray dimensioned for holding said first and second sealing means.

3. A kit as described in claim 1 comprising:

a. elastic means for banding said pipes together placed in said container.

4. A kit as described in claim 1:

a. a small carrying container dimensioned for placement within said container and lid and dimensioned for containing at least two pipes.

5. A kit as described in claim 1 comprising:

a. said walls of said container and lid diverge outwardly; and b. the intersections of said upstanding walls of said container and lid are formed with a radius substantially the same as the radius of said pipes for snugly holding said pipes.

6. A method of assemblying a filter for a cigarette from a kit comprising:

a. selecting a water right shipping container for receiving said pipes and which can serve as a water container and a dispenser;

b. placing a plurality of fiber filled filter pipes in a compact bundle with the mouth pieces on substantially a single plane in a hexagonal water proof packaging container;

c. partially submerging said filter pipes in water in said packaging container until said fiber fill in said pipes is dampened;

d. placing a removable seal in the cigarette holding end of said filter pipes; and e. placing a removable seal on the mouth piece end of said filter pipes.

7. A method as described in claim 1 including:

a. submerging the mouth piece end of said filter pipe to a depth so that the lower end of said filter fill is just below the surface of said water so that said fill is dampened primarily by osmotic action.

8. A method as described in claim 1 comprising:

a. placing an elastic band around said plurality of pipes; and b. selecting either 36, 37, 60 or 61 pipes in said bundle.

9. A method as described in claim 4 comprising:

a. selecting a filter pipe wherein:

1. the outer wall of a portion of the length of said pipe is formed with a plurality of longitudinally extending indents; and 2. said pipe is formed with a longitudinal taper with the mouth piece end having the portion of lesser diameter.

10. A method as described in claim 6 comprising:

a. selecting a container having a hexagonal planar base and six upstanding sidewalls joined to one another.

* * * * *